United States Patent [19]

Lee et al.

[11] 4,167,459

[45] Sep. 11, 1979

[54] ELECTROPLATING WITH NI-CU ALLOY

[75] Inventors: Agnes Y. Lee, Rolla; Wilbert L. Falke, St. James; Alfred E. Schwaneke, Rolla, all of Mo.

[73] Assignee: The United States of America as represented by the Secretary of the Interior, Washington, D.C.

[21] Appl. No.: 1,818

[22] Filed: Jan. 8, 1979

[51] Int. Cl.[2] ..... C25D 3/56; C25D 3/58

[52] U.S. Cl. ..... 204/44

[58] Field of Search ..... 204/44, 123

[56] References Cited

U.S. PATENT DOCUMENTS

| | | | |
|---|---|---|---|
| 1,750,092 | 3/1930 | Crawford et al. | 204/44 |
| 1,951,893 | 3/1934 | Winkler | 204/44 |
| 3,247,082 | 4/1966 | DuRose | 204/44 X |

FOREIGN PATENT DOCUMENTS

| | | | |
|---|---|---|---|
| 957808 | 5/1964 | United Kingdom | 204/44 |

OTHER PUBLICATIONS

B. H. Priscott et al., Trans. Inst. Metal Finishing, vol. 36, pp. 93–96 (1958).

*Primary Examiner*—G. L. Kaplan

*Attorney, Agent, or Firm*—William S. Brown; Donald A. Gardiner

[57] ABSTRACT

Nickel-copper alloy is plated on a metal substrate by electrodeposition of the alloy from an acetate electrolyte solution.

5 Claims, No Drawings

ELECTROPLATING WITH NI-CU ALLOY

Ni-Cu alloys have conventionally been used for providing corrosing resistant and decorative coatings on low-cost metallic substrates. Various means have been employed for application of the Ni-Cu alloy coatings to the substrate metals. For example, the coatings have been formed by means of high temperature diffusion alloying of electrodeposited layers of nickel and copper. In addition, Cu-Ni alloys of about 20 to 45 percent Ni have been electrodeposited from pyrophosphate and citrate electrolyte solutions. Electrodeposition of Ni-Cu alloys on platinum foil or iron or steel substrates, from electrolyte solutions comprising sulfate, acetate and chloride anions, is disclosed in U.S. Pat. No. 1,750,092. None of these prior art processes have, however, been found to be effective in forming highly corrosion resistant, as well as decorative, coatings on lower melting metals such as aluminum, zinc and magnesium, or alloys of these metals.

It has now been found, according to the process of the invention, that such corrosion resistant coatings, consisting of Ni-Cu alloys containing about 50 to 90 percent nickel, may be readily formed on metal substrates such aluminum, zinc or magnesium by electrodeposition of the Ni-Cu alloy from an aqueous electrolyte solution in which the anions consist solely of acetate ions. The process has been found to be particularly effective in formation of the Ni-Cu alloy coatings on zincated aluminum or zincated magnesium substrates. The acetate solutions provide fine-grained, dense, adherent alloy coatings that are highly corrosion resistant and that assume a bright luster with brief buffing.

The process of the invention may be carried out in any conventional electrolytic cell comprising cathode, anode and aqueous electrolyte. The cathode consists of the substrate metal. As discussed above, the preferred substrate is zincated aluminum or magnesium, i.e., aluminum or magnesium to which a layer of zinc, of a thickness of about 0.02 to 0.04 μm, is applied by chemical means such as immersing the properly etched substrate in an alkaline zincate solution. The aluminum or magnesium base from which the zincated substrates are formed need not, however, consist entirely of aluminum or magnesium, but may comprise alloys of these metals with each other or with other metals such as silicon, copper, iron, zinc, manganese or chromium.

The anode may consist of nickel, copper, or nickel-copper alloy. Both anode and cathode may be of any conventional form such as rods, sheets, screens, etc.

The electrolyte consists essentially of an aqueous solution of acetates of nickel and copper, although boric acid in an amount of about 10 to 40 grams per liter is peferably included for the purpose of buffering the electrolyte. Optimum concentrations of the nickel and copper acetates may vary considerably with the desired composition of the Ni-Cu alloy deposit. However, a concentration of nickel acetate of about 75 to 200 grams per liter and copper acetate of about 3 to 20 grams per liter is generally satisfactory. The pH of the electrolyte should be in the range of about 5.0 to 7.0 , with the operating temperature being about 25° to 40° C. Optimum current density may also vary considerably, with values of about 30 to 80 mA/cm$^2$ generally giving good results. Generally, the percent of Ni in the alloy deposit increases with increasing current density.

The process of the invention will be more specifically illustrated by means of the following examples.

EXAMPLE 1

In this example, electroplating of Ni-Cu alloy was conducted in a 1-liter beaker, with aqueous acetate solution as electrolyte. The cathode consisted of a freshly-etched and zincated aluminum sheet having the dimensions 3.8×3.8×0.16 cm. Two parallel nickel anodes, each 5 cm wide and 15 cm long, were employed, with the cathode positioned between the anodes, and constant current was drawn from a dc power supply.

The electrolyte consisted of an aqueous solution of 125 grams per liter of nickel acetate, 10 grams per liter of copper acetate and 15.5 grams per liter of boric acid. The pH of the electrolyte was 5.5, and the operating temperature and current density were maintained at 30° C. and 50 mA/cm$^2$ respectively.

Electrolysis was conducted for a period of 1 minute, resulting in deposition of a homogenous Ni-Cu alloy coating of a thickness of about 1 μm, and containing about 70 percent Ni. After brief buffings, the coating became mirror bright and, in addition, exhibited excellent corrosion resistance as measured by visual examination of the specimen after being exposed for 2 weeks in a chamber at 60° C. and 100 percent humidity.

EXAMPLES 3-5

In these examples, the electrolyte contained chloride and/or sulfate, as well as acetate, salts, as shown in the following table. Conditions were otherwise similar to those of example 1.

| Example | Electrolyte Composition | Grams/liter |
|---|---|---|
| 2 | Nickel acetate | 124.4 |
| | Copper acetate | 6.8 |
| | Nickel chloride | 23.5 |
| | Boric acid | 15.5 |
| 3 | Nickel acetate | 124.4 |
| | Copper acetate | 6.8 |
| | Copper chloride | 3.4 |
| | Boric acid | 31.0 |
| 4 | Nickel sulfate | 112.0 |
| | Copper chloride | 3.4 |
| | Sodium sulfate | 112.0 |
| | Ammonium chloride | 35.0 |
| | Boric acid | 15.5 |

In example 2, the resulting alloy coating was striated and had low corrosion resistance as shown by a pitted specimen which was exposed for 2 weeks in a chamber at 60° C. and 100 percent humidity.

The electrolyte of example 3 formed a poorly adhered coating, while that of example 4 formed a dark and powdery deposit. It is thus apparent that the presence of chloride or sulfate salts in the electrolyte solution resulted in formation of Ni-Cu alloy deposits that were distinctly inferior in adherence, appearance or corrosion resistance as compared to those formed when only acetate salts were employed.

We claim:

1. A process for electrodeposition of nickel-copper alloy on a metallic substrate comprising:

(a) providing an electrolyte bath consisting essentially of an aqueous solution of nickel acetate, copper acetate and boric acid, (b) providing in said bath a cathode consisting essentially of said metallic substrate, (c) providing in said bath an anode consisting essentially of nickel, copper or nickel-copper alloy, and (d) applying between said anode and cathode a d.c. current of sufficient magnitude and duration to form an adherent, corrosion resistant coating of nickel-copper alloy on the substrate.

2. The process of claim 1 in which the electrolyte bath contains about 75 to 200 grams per liter of nickel acetate, about 3 to 20 grams per liter of copper acetate and about 10 to 40 grams per liter of boric acid.

3. The process of claim 1 in which said metallic substrate consists essentially of aluminum or its alloys.

4. The process of claim 1 in which said metallic substrate consists essentially of magnesium or its alloys.

5. The process of claim 1 in which said metallic substrate consists essentially of zinc or its alloys.

* * * * *